US006429395B1

(12) United States Patent
Wei

(10) Patent No.: US 6,429,395 B1
(45) Date of Patent: Aug. 6, 2002

(54) LEAKPROOF DEVICE OF WIRE CUT MACHINE

(76) Inventor: Yu-Hwa Wei, P.O. Box 487, Changhua City 500 (TW)

( * ) Notice: Subject to any disclaimer, the term of this patent is extended or adjusted under 35 U.S.C. 154(b) by 0 days.

(21) Appl. No.: 09/597,827

(22) Filed: Jun. 19, 2000

(30) Foreign Application Priority Data

Jan. 13, 2000 (TW) ..... 089200588

(51) Int. Cl.[7] ..... B23H 7/10
(52) U.S. Cl. ..... 219/69.12; 219/69.14
(58) Field of Search ..... 219/69.12, 69.14

(56) References Cited

U.S. PATENT DOCUMENTS 4,565,915 A * 1/1986 Girardin ..... 219/69.12
4,647,747 A * 3/1987 Gato ..... 219/69.12
4,808,786 A * 2/1989 Shinkai et al. ..... 219/69.12
4,992,640 A * 2/1991 Tanaka et al. ..... 219/69.12
5,028,757 A * 7/1991 Aramaki et al. ..... 219/69.12
5,111,016 A * 5/1992 Lodetti et al. ..... 219/69.12
5,171,955 A * 12/1992 Hosaka et al. ..... 219/69.12
5,196,666 A * 3/1993 Hosaka ..... 219/69.12
5,374,795 A * 12/1994 Enami ..... 219/69.12
5,780,801 A * 7/1998 Maidagan ..... 219/69.14

* cited by examiner

*Primary Examiner*—Geoffrey S. Evans

(57) ABSTRACT

A leakproof device of the work tank of a wire cut machine comprising a fixed plate fastened on the work tank, and a locating plate fastened with a lower arm of the wire cut machine. The fixed plate is provided in the fringe of a hollow portion thereof with an annular slot into which the compressed air is injected to form an air wall to reduce the friction between fixed plate and movable plate, also to prevent the machining fluid leaking from the work tank.

3 Claims, 5 Drawing Sheets

LEAKPROOF DEVICE OF WIRE CUT MACHINE

FIELD OF THE INVENTION

The present invention relates generally to a wire cut machine, and more particularly to a leakproof device of the work tank of the wire cut machine.

BACKGROUND OF THE INVENTION

The conventional leakproof device of the work tank of the wire cut machine comprises a movable plate and a fixed plate. The movable plate is fastened with the lower arm its put through the work tank. Such a conventional leakproof device as described above is defective in design in that the movable plate and the fixed plate possibility susceptible to wear due to the mechanical friction. In light of an increase in the friction coefficient of the plates, the lower arm is apt to shake when work table moving. As a result, the precision of the wire cut machine is undermined.

FIG. 1 shows a perspective view of a wire cut discharge machine of the prior art. FIG. 2 shows a sectional view of a leakproof device for a wire cut discharge machine of the prior art with a lower arm (element 2), a locating plate (element A), a movable plate (element B), and a fixed plate (element C), a plurality of adjustment screws (element 35), and a spring (element 34).

SUMMARY OF THE INVENTION

The primary objective of the present invention is to provide the work tank of a wire cut machine with a leakproof device its leak-free from the drawbacks of the conventional leakproof device described above.

In keeping with the principle of the present invention, the foregoing objective of the present invention is attained by a leakproof device comprising a lower arm, a locating plate fastened with the lower arm, a fixed plate fastened on the work tank of the wire cut machine. The fixed plate is provided along the fringe of a hollow portion thereof with an annular slot its in turn provided with a gap nozzle via which the compressed air is injected into the annular slot to form an air wall. The air wall serves to reduce the mechanical friction between the fixed plate and the movable plate located between the fixed plate and the locating plate. The air wall also serves to prevent the leak of the finishing fluid contained in the work tank.

DETAILED DESCRIPTION OF THE INVENTION

Figure 1:
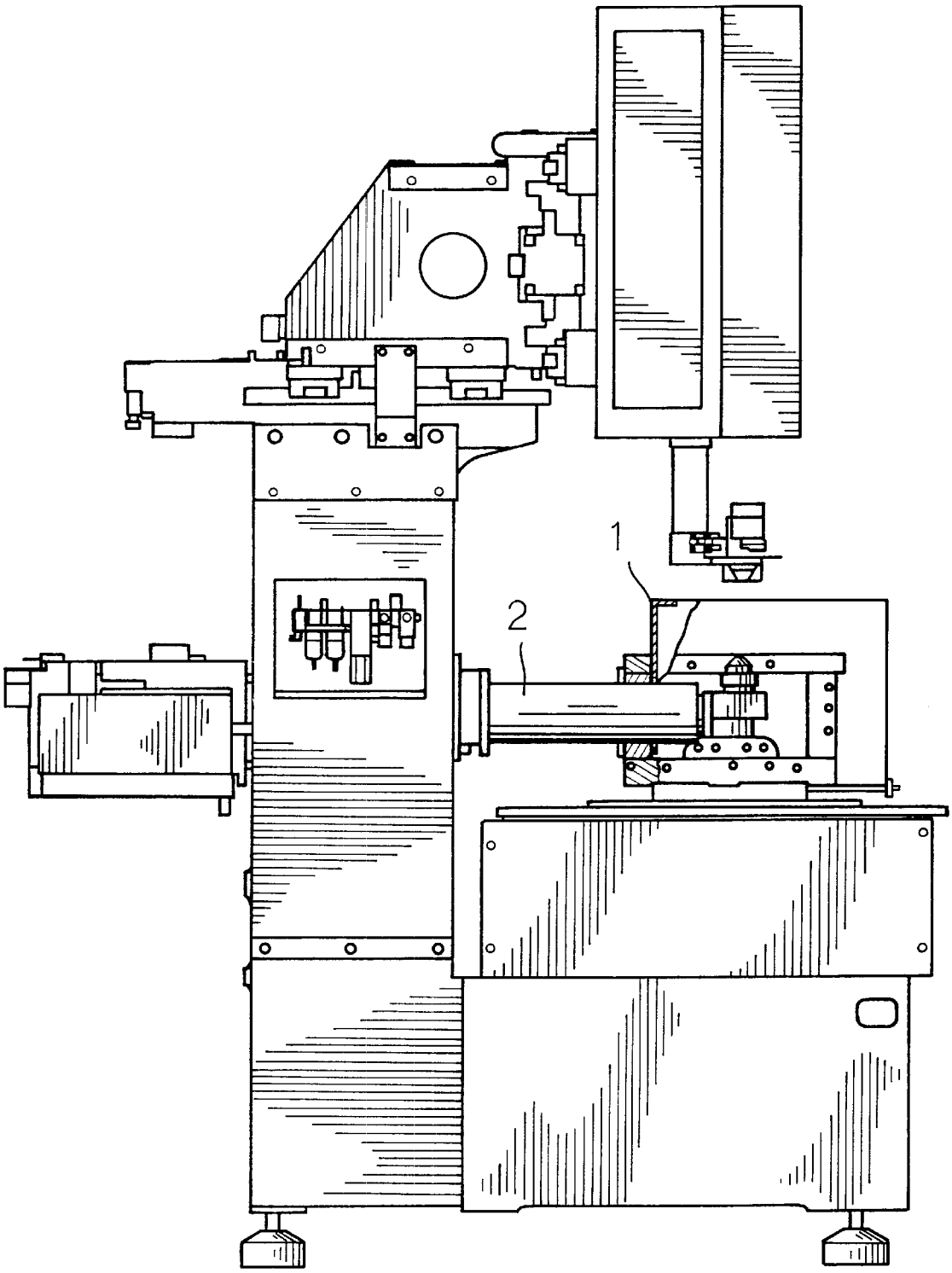
FIG. 1 shows a perspective view of a wire cut machine of the prior art.
Figure 2:
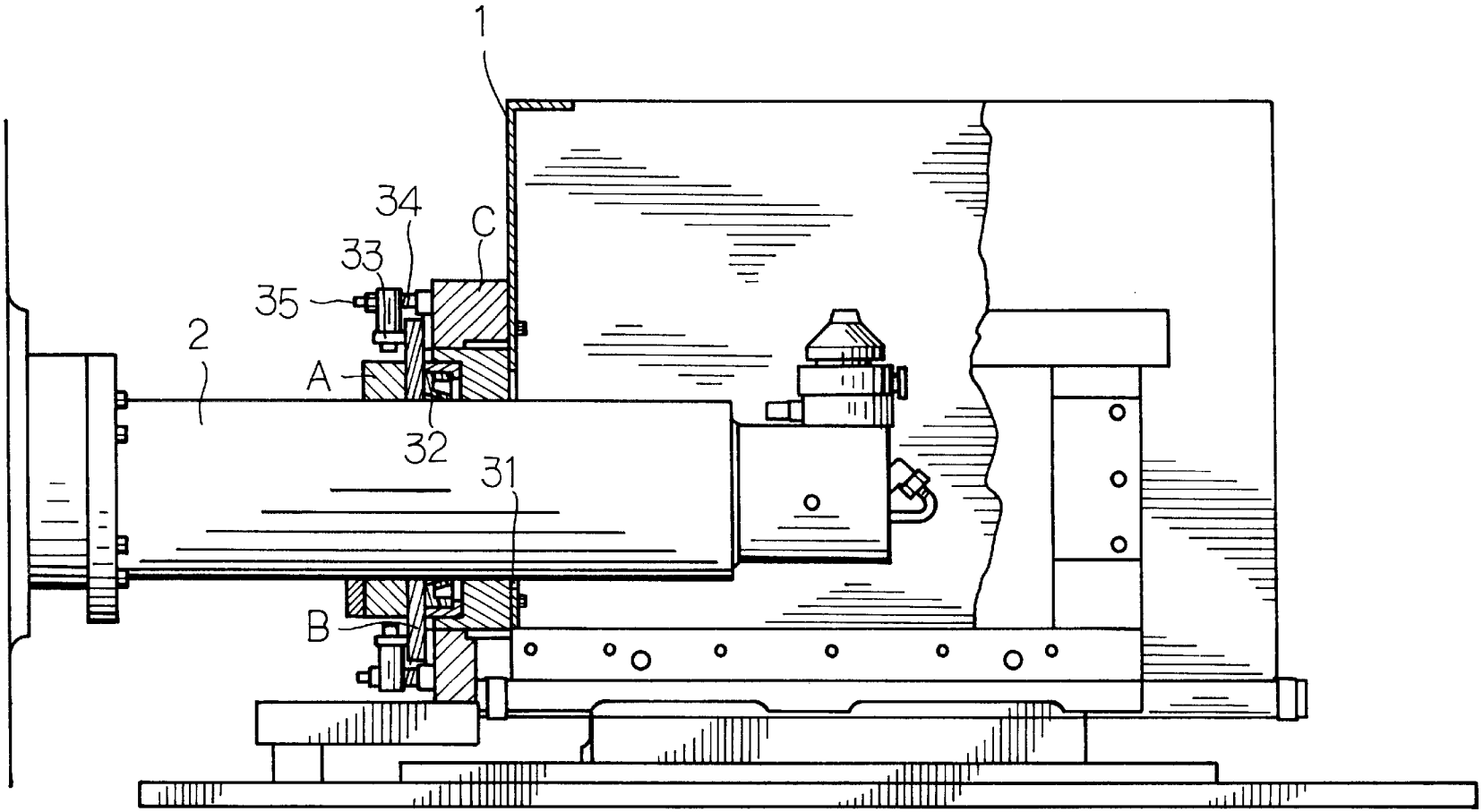
FIG. 2 shows a sectional view of a leakproof device of the wire cut machine of the prior art.
Figure 3:
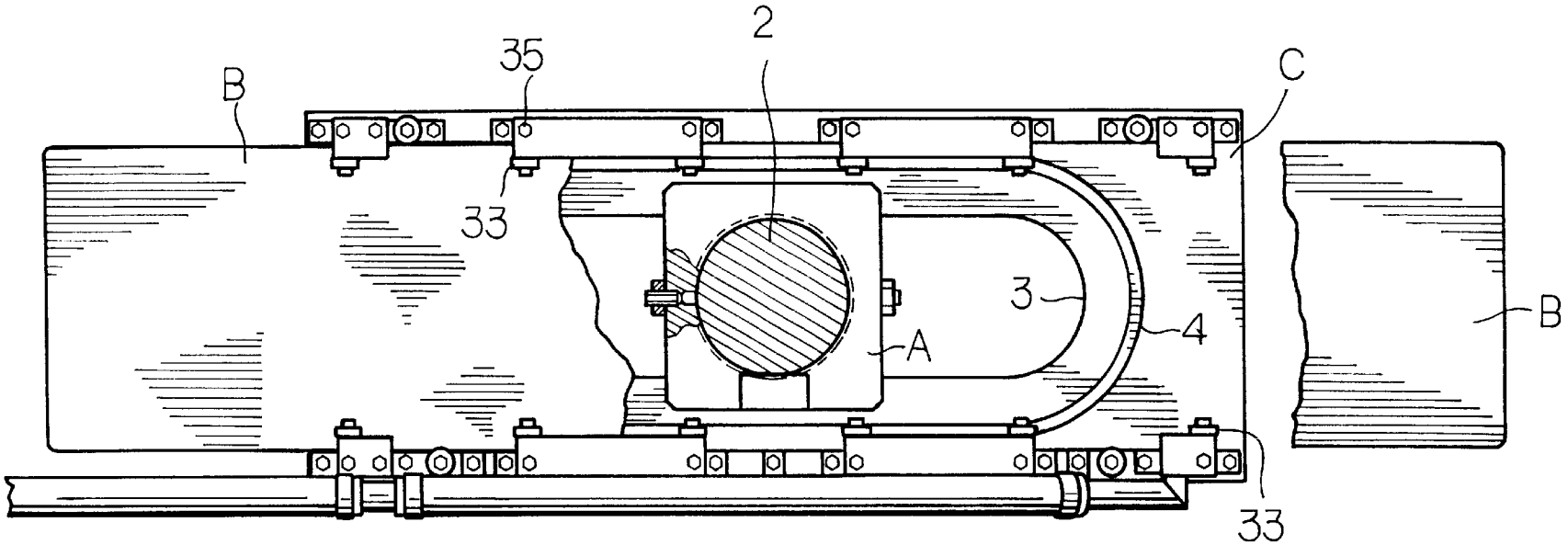
FIG. 3 shows a front sectional view of a leakproof device of the present invention.
Figure 4:
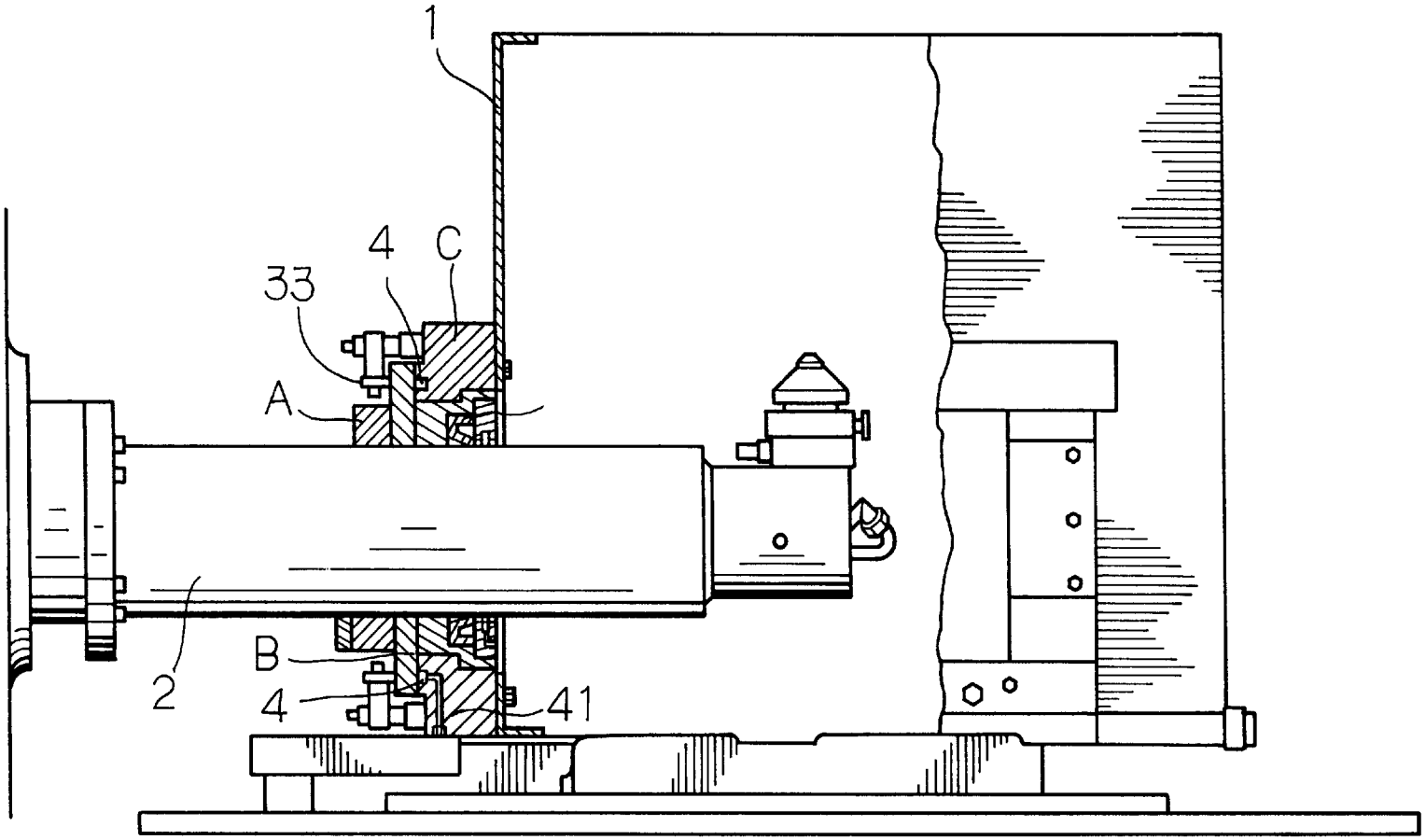
FIG. 4 shows a sectional view of the leakproof device of the present invention.
Figure 5:
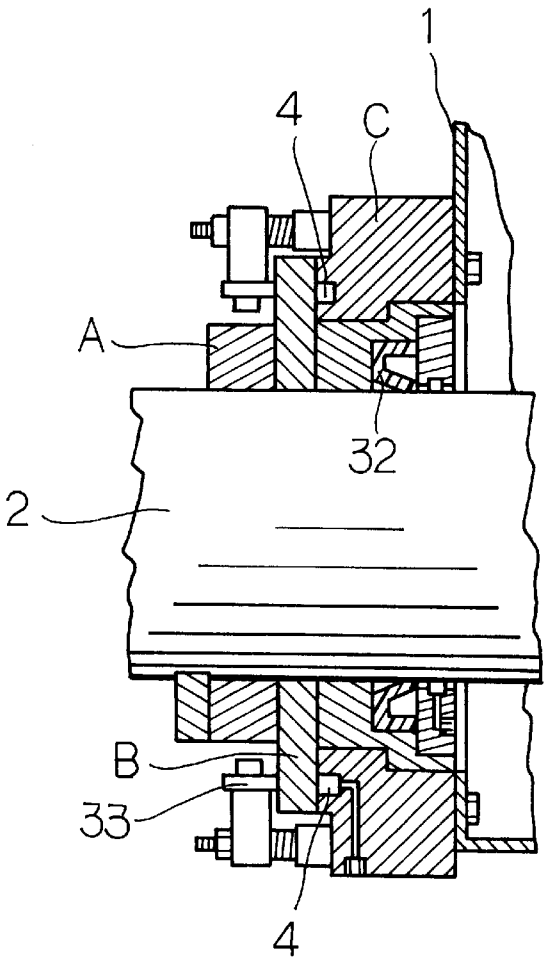
FIG. 5 shows an enlarged sectional view of the leakproof device of the present invention.

As shown in FIGS. 3–5, a leakproof device embodied in the present invention is disposed between a work tank 1 and a lower arm 2 of a wire cut machine. The lower arm 2 is provided with a locating plate A fastened therewith, and a fixed plate C fastened therewith and provided with a hollow portion 3 of an oval shape. The fixed plate C is provided with a plurality of rollers 33 fastened therewith by a plurality of adjustment screws 35 in conjunction with a spring 34. Located between the rollers 33 is a movable plate B. When the work tank 1 is moved leftward and rightward, the fixed plate C slide on the movable plate B, the tightness between the movable plate B and the fixed plate C is adjusted by the adjustment screws 35.

The present invention is characterized by the fixed plate C, which is provided along the fringe of the hollow portion 3 thereof with at least one annular slot 4 its in turn provided with one or more gap nozzles 41. The annular slot 4 is provided with the compressed air injected thereinto via the gap nozzles 41. The compressed air forms an air wall along the annular slot 4. The air wall serves to reduce the friction between the fixed plate C and the movable plate B. In addition, the air wall serves to prevent the leak of the finishing fluid contained in the work tank 1. A finishing fluid may be injected into the annular slot 4 to form a fluid wall in place of the air wall.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the followings appended claims.

What claimed is:

1. A leakproof device of the work tank of a wire cut machine, said leakproof device comprising a fixed plate fastened on the work tank, and a movable plate fastened with the lower arm, and a locating plate fastened on the lower arm, said fixed plate being provided with a plurality of rollers pivoted thereto for enabling said fixed plate to slide on said movable plate, said fixed plate further provided with a hollow portion of an oval construction; wherein said fixed plate is provided in the fringe of the hollow portion thereof with an annular slot whereby said annular slot is provided with a gap nozzle for injecting the compressed air into said annular slot in which the compressed air forms an air wall.

2. The leakproof device as defined in claim 1, wherein said fixed plate is provided in the fringe of the hollow portion thereof with a plurality of annular slots whereby said annular slots are respectively provided with the compressed air having a predetermined air pressure.

3. The leakproof device as defined in claim 1, wherein said annular slot of said hollow portion of said fixed plate is provided with a machining fluid in place of the compressed air.

* * * * *